US006222450B1

(12) United States Patent
Clements

(10) Patent No.: US 6,222,450 B1
(45) Date of Patent: Apr. 24, 2001

(54) METAL DETECTION DEVICE HAVING IMPROVED SUPPORT ASSEMBLY

(75) Inventor: Philip E. Clements, Littleton, CO (US)

(73) Assignee: Denver Dynamics, Inc., Englewood, CO (US)

( * ) Notice: Subject to any disclaimer, the term of this patent is extended or adjusted under 35 U.S.C. 154(b) by 0 days.

(21) Appl. No.: 09/496,899

(22) Filed: Feb. 2, 2000

(51) Int. Cl.[7] ..... G08B 13/14
(52) U.S. Cl. ..... 340/568.1; 209/219; 324/239
(58) Field of Search ..... 340/568.1, 540, 340/674; 209/549, 215, 219; 324/239, 243, 260, 228

(56) References Cited

U.S. PATENT DOCUMENTS

| | | | | |
|---|---|---|---|---|
| 4,367,138 | * | 1/1983 | Kustas | 209/224 |
| 4,494,657 | * | 1/1985 | Oldenkamp | 209/219 |
| 4,632,253 | * | 12/1986 | Stromgren et al. | 209/570 |
| 4,742,339 | * | 5/1988 | Baziuk | 340/568 |
| 4,782,970 | * | 11/1988 | Edwards | 209/223.1 |
| 5,001,425 | * | 3/1991 | Beling et al. | 340/568 |
| 5,576,621 | * | 11/1996 | Clements | 340/568 |
| 5,659,247 | * | 8/1997 | Clements | 324/239 |

* cited by examiner

*Primary Examiner*—Jeffery Hofsass
*Assistant Examiner*—John Tweel, Jr.
(74) *Attorney, Agent, or Firm*—John L. Isaac; Isaac & Associates

(57) ABSTRACT

A support assembly for a metal detection device is disclosed. The detection device includes a housing with a central orifice, an induction member surrounding the orifice for generating an output voltage when a metal object is passed nearby, and a mechanism which includes pulse emitting and pulse receiving members for selectively sensing an object passing through the orifice. The support assembly includes a base member having front, rear and opposed side portions sized and shaped for positioning beneath the housing. The base member has a central aperture adapted for substantial alignment with the housing orifice when the base member is positioned beneath the housing. A mechanism secures the base member to the housing, and a plurality of mounting posts are disposed along the base member front, rear and side portions for positioning a metal detection device induction member about the central aperture. A mounting mechanism is provided for the pulse emitting and pulse-receiving members on opposite sides of the central aperture. Finally, a plurality of pulse regulating elements are provided for eliminating ambient light interference and cross-pulse sensing.

22 Claims, 9 Drawing Sheets

10
62
60
30
22
12
55
142
58
26
142
120
28
124
108
102
100
104
138
136
128
134

METAL DETECTION DEVICE HAVING IMPROVED SUPPORT ASSEMBLY

RELATED APPLICATIONS

This is related to U.S. Pat. No. 5,659,247 issued Aug. 19, 1997 and U.S. Pat. No. 5,576,621 issued Nov. 19, 1996, the contents of which are specifically incorporated herein by reference.

BACKGROUND OF THE INVENTION

1. Field of the Invention

This invention relates generally to metal detection devices designed to detect the inadvertent disposal of metal articles into waste receptacles and, more particularly, to a metal detector designed to detect the inadvertent disposal of metal objects such as surgical instruments into disposal receptacles particularly useful in medical facilities and the like. Specifically, the present invention relates to a support assembly for the operating components of such a metal detection device.

2. Description of the Prior Art

One of the major problems in the health care industry today is the high cost of patient care. While many factors contribute to this cost, one of these factors is the difficulty in controlling waste in a hospital environment. In the operating room, surgical instruments are inadvertently but routinely discarded along with the disposable drapes and gowns after an operation. These expensive instruments are intended for reuse, and their disposal represents a substantial waste. In addition, theft of such instruments and small metallic objects also occurs through such disposal mechanisms. A survey of randomly selected hospitals revealed that such wasteful disposal and theft of surgical instruments amounted to losses between $30,000–$50,000 per year per operating room. In a typical hospital having six to ten operating rooms, such loss is substantial.

Moreover, used disposable surgical drapes and gowns, by law, are required to be deposited in a so-called "red bag" designated for infectious waste. Such red bags are approximately the size of a lawn and garden trash and leaf bag. The red bags are held for use in an open position in each operating room by a bag holder, typically in the form of a wheeled cart. Hospital personnel merely wad up used drapes and gowns and stuff them into the red bag for disposal. As can be readily appreciated, valuable surgical instruments, typically fashioned from an expensive grade of stainless steel, can easily become bundled with the used drapes and gowns, and disposed inadvertently or otherwise.

In penal institutions such as jails and prisons, prisoners are encouraged to participate in various jobs and vocational training programs including welding, mechanics and machining. Some inmates, consequently, have access to machine tools and metal stock materials from which they might fashion weapons. Receptacles for trash and laundry, although necessary in the daily operations of such penal institutions, create the potential for the smuggling by inmates of weapons and potential weapon stock material from shop and training areas to other locations. Accordingly, the monitoring and search of such receptacles place a substantial burden on guards, and thus increases the operating costs of these institutions.

Metal detectors of various types are well known in the art. U.S. Pat. No. 3,065,412 discloses a metal detector useful in its detection of metallic impurities in powders, while U.S. Pat. No. 4,821,023 discloses a walk-through metal detector useful at airports. Thus, metal detection devices have been applied in a wide variety of uses in the past. U.S. Pat. No. 4,632,253 and U.S. Pat. No. 4,782,970 disclose devices that are specifically designed to detect the inadvertent disposal of cutlery into a trash container in restaurant environments. Both these patent references disclose devices which are designed to cover trash containers, the first one of which utilizes an inductive probe to detect metal cutlery so as to close a flap to prevent its disposal into the trash container, while the latter reference discloses a magnetic arrangement which traps cutlery prior to being deposited into the receptacle.

U.S. Pat. No. 5,001,425 discloses a device designed to cover a receptacle for use in a hospital environment to detect the inadvertent disposal of metal articles in such a receptacle. As is pointed out therein, however, a significant problem in a hospital environment, and in particular surgical environments, is the presence of numerous metal objects surrounding the receptacle. Such metal objects proximate the detector can cause the inadvertent triggering of the detector alarm system without a metallic article having actually been placed therein due to false readings from metal articles immediately surrounding or near the top of such a receptacle. Thus, there is a need for a metal detector that is designed to detect the inadvertent disposal of small metal objects into a receptacle in a hospital, prison or kitchen environment, which is reliable and designed to prevent false signals from being registered due to the presence of metal articles on or near the top or exterior of such a receptacle without having been placed therein. The devices illustrated in the above-identified related U.S. Pat. No. 5,659,247 and U.S. Pat. No. 5,576,621 are designed to meet these needs. However, there remains a need to be able to mass produce such devices in a manner that is both economically viable as well as permits the accurate placement of the operational components of these devices, which placement is extremely important for the proper operation and long term use of the devices. The present invention satisfies this need.

SUMMARY OF THE INVENTION

Accordingly, it is one object of the present invention to provide a device to detect the inadvertent disposal of surgical instruments and other small metal articles into a receptacle to allow for their retrieval and reuse.

It is another object of the present invention to provide a device to assist in the monitoring of receptacles to prevent the unauthorized deposit of metal articles therein to prevent theft or the undetected transfer of metal articles using such receptacles.

It is yet another object of the present invention to provide a metal detector for receptacles useful in surgical operating rooms or kitchen environments for the detection of inadvertent disposal of metal articles therein while preventing false alarms or signals resulting from metal material or articles on or near such receptacles.

Still another object of the present invention is to provide a metal detector for receptacles which is able to be mass produced in a manner that is both economically viable as well as permits the accurate placement and maintenance of the operational components of these devices.

Finally, it is another object of the present invention to provide a metal detector which is readily attachable and removable from wheeled receptacles and which includes a support structure which accurately positions the sensing elements of the device throughout the operational lifetime of the detector.

To achieve the foregoing and other objects and in accordance with the purpose of the present invention, as embodied and broadly described herein, a support assembly for a metal detection device is disclosed. The detection device includes a housing with a central orifice, an induction member surrounding the orifice for generating an output voltage when a metal object is passed nearby, and a mechanism which includes pulse emitting and pulse receiving members for selectively sensing an object passing through the orifice. The support assembly includes a base member having front, rear and opposed side portions sized and shaped for positioning beneath the housing. The base member has a central aperture adapted for substantial alignment with the housing orifice when the base member is positioned beneath the housing. A mechanism secures the base member to the housing, and a plurality of mounting posts are disposed along the base member front, rear and side portions for positioning a metal detection device induction member about the central aperture. A mounting mechanism is provided for the pulse emitting and pulse-receiving members on opposite sides of the central aperture. Finally, a plurality of pulse regulating elements are provided for eliminating ambient light interference and cross-pulse sensing in the pulse-receiving members.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 1:
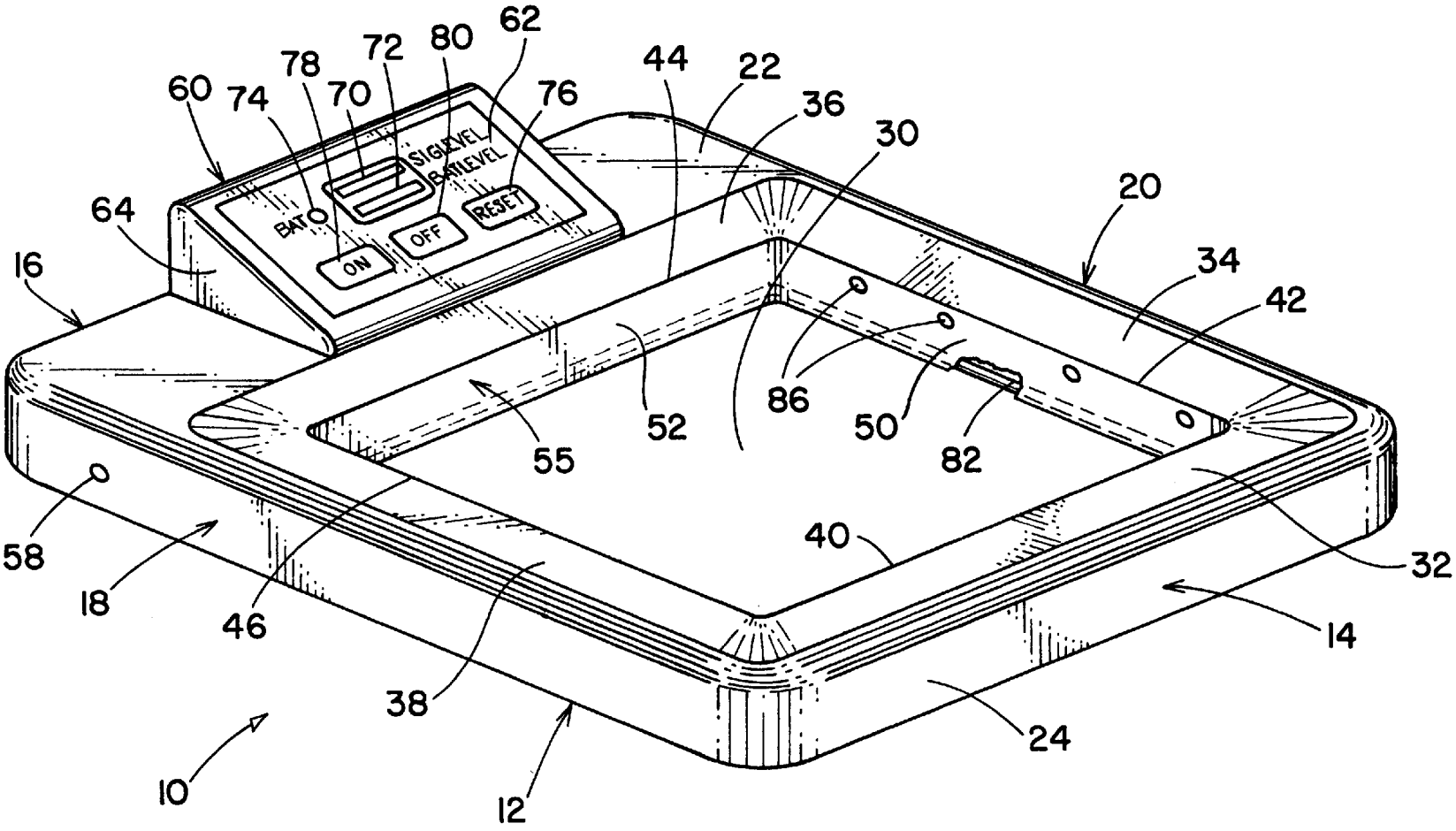
FIG. 1 is a front perspective view of a metal detector constructed in accordance with the present invention.
Figure 2:
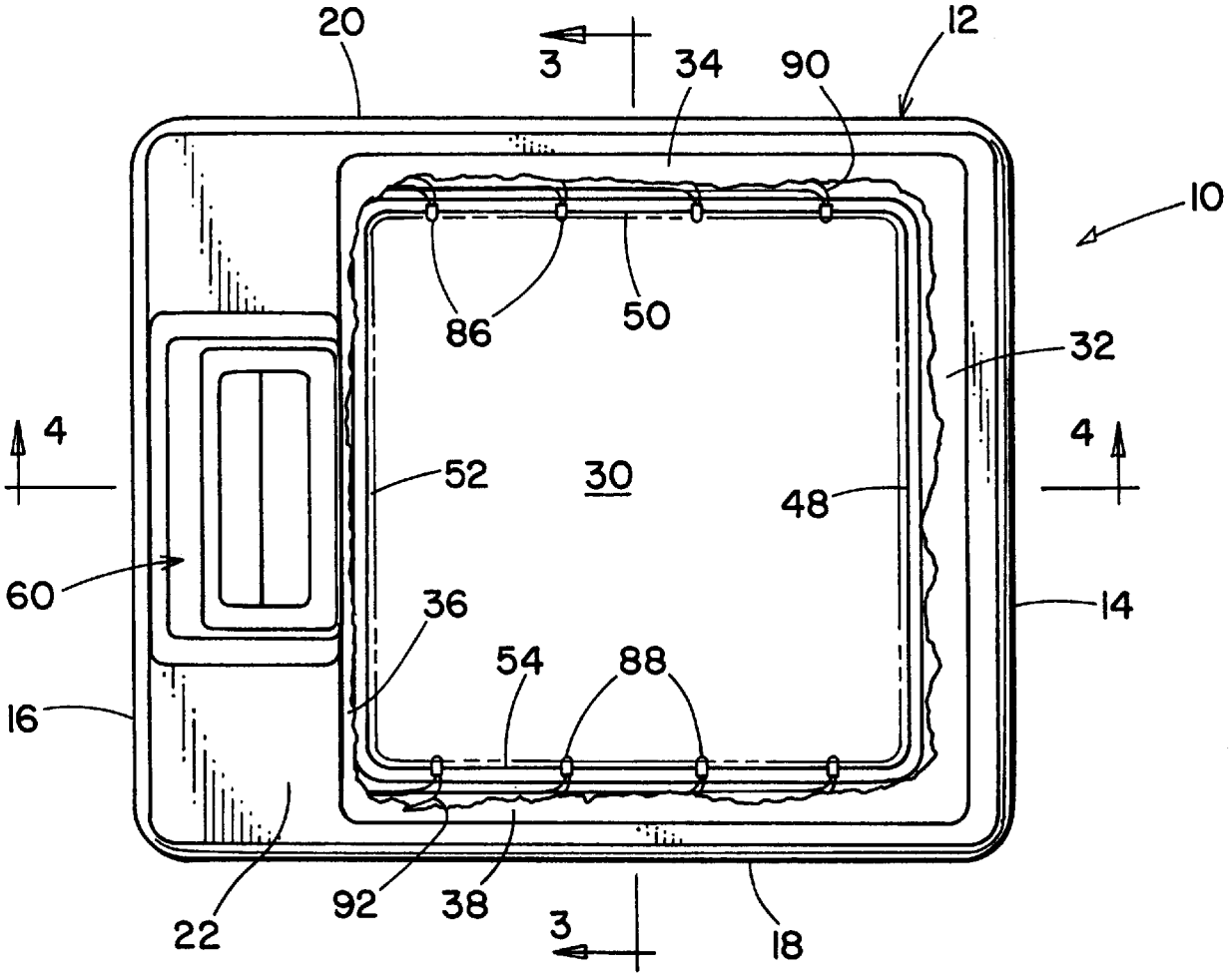
FIG. 2 is a top plan view, with some parts in section, of the detector device illustrated in FIG. 1.
Figure 3:
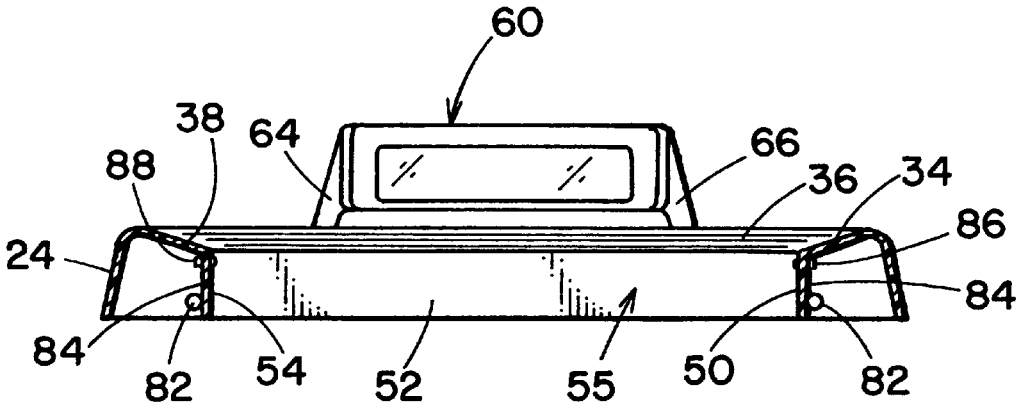
FIG. 3 is a cross-sectional view taken substantially along line 3—3 of FIG. 2.

Referring now to the drawings and in particular to FIGS. 1–6, a metal detector device 10 is disclosed and includes a housing 12 having a front portion 14, a rear portion 16 and two side portions 18 and 20, all of which are interconnected by a top surface 22. In preferred form, the housing 12 is substantially rectangular in shape and includes an exterior circumferential lip 24 that depends downwardly from the top surface 22 along the front and rear portions 14, 16 and the side portions 18, 20. The lip 24 provides a surface for mounting the housing 12 to a receptacle structure 26 utilizing a support assembly as further described below.

The housing 12 is preferably constructed from any type of known non-metallic material and is most preferably constructed from molded plastic. In preferred form, the housing 12 is formed as an integral component in a rotational molding process wherein a powdered plastic resin material gradually melts within a heated, rotating mold. The liquefied resin then coats the interior surfaces of the mold to form the housing 12. After cooling, the housing 12 is then removed from the mold. In the instant case, the mold is preferably configured to produce two component parts simultaneously which are severed after removal from the mold. A preferred plastic resin material is polypropylene, although a wide variety of other plastics or non-ferrous materials may also be employed.

The housing 12 preferably includes a central aperture or opening 30 which in preferred form is substantially square in shape. A plurality of inclined surfaces 32, 34, 36 and 38 depend angularly downwardly from the top surface 22 toward the aperture 30 and terminate at the respective edges 40, 42, 44 and 46. A plurality of flanges 48, 50, 52 and 54 each extend vertically downwardly from their respective side edges 40, 42, 44 and 46 to form a substantially square tube portion 55 defining the aperture 30. In use, the opening 30 overlies and communicates with a top opening of a waste disposal bag 28. Accordingly, the inclined surfaces 32–38, the tube 55 and the aperture 30 facilitate the deposit of articles and material into the disposal bag 28 carried by the receptacle 26.

In one embodiment, a pair of pivot arms 56 may be preferably secured to the side edges 18, 20 of the housing 12 by a pair of mounting pins 58 in order to secure the housing 12 to the receptacle 26 in a hinged manner as described in greater detail below. This is not utilized, however, with the support assembly described below. In any event, the housing 12 is arranged to be pivoted away from the disposal bag 28 in order to remove the disposal bag 28 from the receptacle 26 when it is full.

A control console 60 extends upwardly from a rear portion of the top 22 of housing 12 and preferably includes a downwardly and forwardly inclined control panel 62 surrounded by side members 64, 66. As particularly illustrated in FIG. 4, a hollow interior control box 68 is disposed within the interior of the console 60 and forms a housing for the electronic components of the metal detector 10 as described in greater detail in the related and previously incorporated U.S. Pat. No. 5,659,247.

The control panel 62 may include a peak-hold type LCD bar graph 70 for displaying voltage levels induced in the detection circuitry by the deposit of metal articles through the aperture 30 of the housing 12 in order to allow an operator to estimate the size of the metal article disposed. Thus, an insignificant metal object such as a surgical staple or the like would provide a low signal level and would not set off the alarm as described in greater detail below, while a large and expensive surgical instrument would provide a high signal level and set off the alarm. The peak-hold feature causes the graph 70 to maintain the display for a time sufficient to enable operator inspection. In addition, a similar LCD bar graph 72 provides an indication of battery voltage to allow an operator to estimate the remaining battery life for the unit 10. Finally, an LED low battery indicator 74 provides a positive indication of the need to recharge the batteries for the detector 10.

The metal detector 10 is designed for ease of operation with minimal training. Toward this end, user friendly controls preferably comprise three buttons including a reset button 76, an "n" button 78 and an "off" button 80. The reset button 76 is designed to silence an audible alarm after detection of a metal article and to reset the metal detector for continued use. The "on" button 78 activates the power to the device 10 while the "off" button 80 deactivates the power source. The control panel 62 is preferably of a flexible membrane type commonly employed in microwave ovens in which the control buttons 76, 78 and 80 comprise zones designated by indicia which do not protrude above the panel 62. The LCD bar graph displays 70 and 72 and the LED light 74 underlie the panel 62 and are displayed through transparent windows. Panels of this type are custom fabricated pursuant to customer specification by any number of vendors, and are well known to the art.

In preferred form, an induction member in the form of a detection coil 82 surrounds the aperture 30 and is designed to detect the presence of metal proximate thereto, particularly as it passes through the aperture 30. The detection coil 82 in one form is mounted to the outside surfaces 84 of the tube portion 55 which defines the aperture 30. In preferred form, the detection coil 82 is mounted to the support assembly as described below. While any type of induction member suitable for use in the present invention may be utilized as the detection coil 82, is preferred that the primary coil be 26 gauge copper wire wound sixteen turns about the aperture 30 and that the detector coil 82 also be 26 gauge copper wire wound six turns about the aperture 30. In this manner, when a metal object moves physically near the detection coil 82, it causes a change in the electromagnetic field surrounding the coil 82, and this causes a change in the current described below. This is true, however, whether the metal article is proximate the coil 82 by being placed through the aperture 30 or proximate the coil 82 by being placed against, on top or even nearby the housing 12.

In order to insure that the detector 10 only detects metal articles passing through the aperture 30 and avoids any false readings from metal articles passing near the detection coil 82 outside the exterior housing 12, a mechanism for sensing an object, metallic or otherwise, physically passing through the aperture 30 is disposed about the aperture 30. In preferred form, this mechanism includes a plurality of pulse emitting members 86 which preferably are in the form of light emitting diodes (LED's), and a plurality of pulse detecting members 88 preferably in the form of infrared phototransistors. While the preferred form of the members 86, 88 include infrared LED's and infrared phototransistors, ultrasound emitters and detectors may also be utilized. Preferably, there are sufficient numbers of pulse emitting members 86 disposed along one flange 50 and sufficient numbers of pulse detection members 88 disposed along the opposite flange 54 in order to span the entire cross-sectional area of the aperture 30. The pulse emitting members 86 are preferably positioned proximate the edge 42 away from the coil 82 to minimize electrical interference and are interconnected to the electronic components of the console 60 by wiring 90. Likewise the pulse detecting members 88 are positioned proximate the edge 46 away from the coil 82 and are connected to the console 60 by wiring 92. In preferred form, there are equal numbers of pulse emitting members 86 and pulse detecting members 88 aligned opposite each other so that as an object passes through the aperture 30, it physically interferes with the detection by at least one member 88 of a pulse being emitted from the members 86, and this interference is monitored by the members 88 and signaled to the control panel 60 in a manner described below.

In preferred form, a rechargeable nickel-cadmium or nickel metal hydride battery 94 provides all operating power for the detection circuitry of the device 10. A jack 96 extends through the rear portion 16 and allows connection of the battery 94 to a conventional recharging device in a conventional manner.

In general, the device 10 of the present invention operates by powering the detection coil 82 so as to create a magnetic field surrounding it. If a metal member passes proximate to the detection coil 82, a change is detected in the electromagnetic field therein. A mechanism, described in the referenced patent, calibrates the detection coil 82 by comparing the output voltage thereof caused by a change in the electromagnetic field thereabout to a reference voltage to establish a threshold voltage which is unaffected by transient fluctuations in the coil output voltage as described below. When the threshold voltage of the detection coil 82 is exceeded, an electric signal is generated to simultaneously activate the pulse emitting members 86. If all the pulse emitting members 86 are detected by the pulse detection members 88, nothing happens since it is clear that an object has not passed through the aperture 30, and that the threshold voltage activated by the detection coil 82 was the result of a metal member passing near but outside the housing 12. However, should the threshold voltage of coil 82 be exceeded so as to activate the pulse emitting members 86, and one or more of the pulse detection members 88 is not activated, an alarm is triggered in response to the lack of activation by one or more of the pulse detection members. The only manner in which a pulse detection member 88 would not be activated is due to the physical blockage of the pulse emitted from a member 86 to prevent its paired member 88 from receiving and detecting the pulse. In addition, since the pulse emitting members 86 are only activated or turned on when the threshold voltage of the coil 82 is surpassed, non-metallic objects can consistently pass through the aperture 30 without generating an alarm signal since the pulse emitting members 86 are in a non-active state. Consequently, the combination of the detection coil 82, the pulse emitting members 86 and the pulse detection members 88 and the circuitry interconnecting the same prevents false signals caused by metallic objects exterior to but proximate the detector 10 from being generated.

Figure 4:
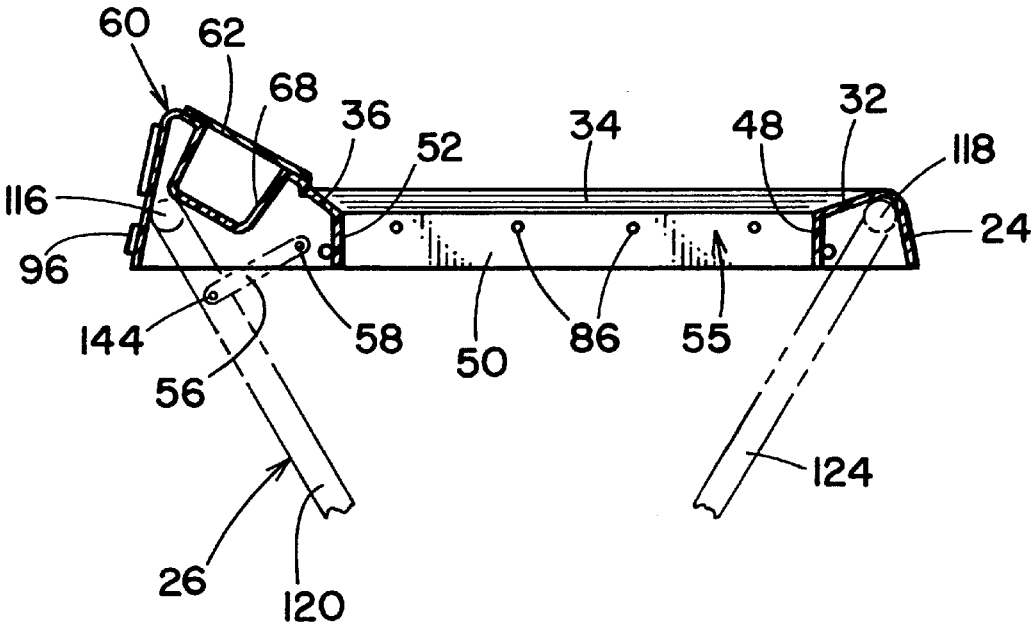
FIG. 4 is cross-sectional view taken substantially along line 4—4 of FIG. 2 and illustrating placement of the device without the support assembly of the invention onto a receptacle support member.
Figure 5:
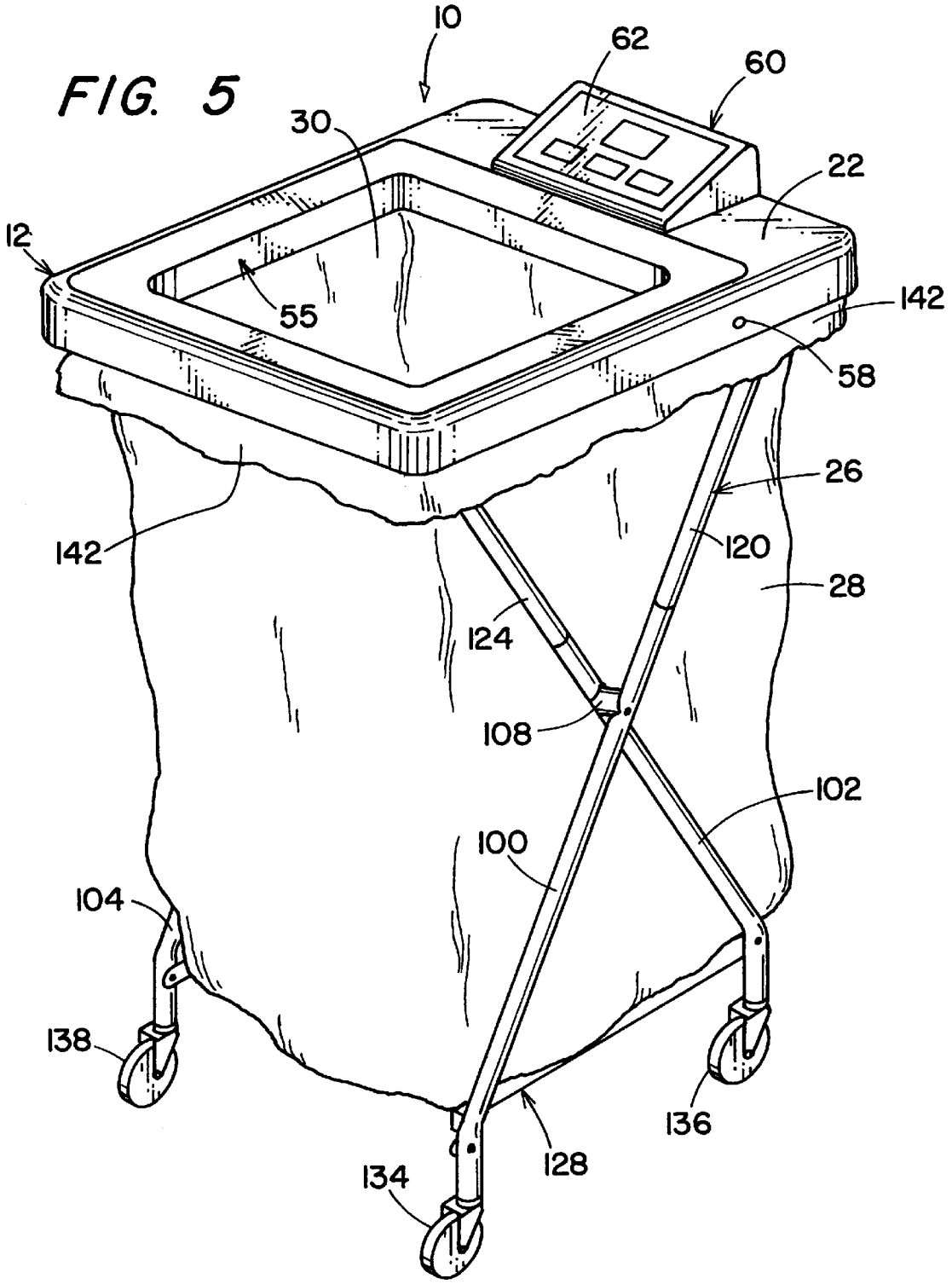
FIG. 5 is a side perspective view of the detector device constructed in accordance with present invention mounted onto a portable receptacle member.
Figure 6:
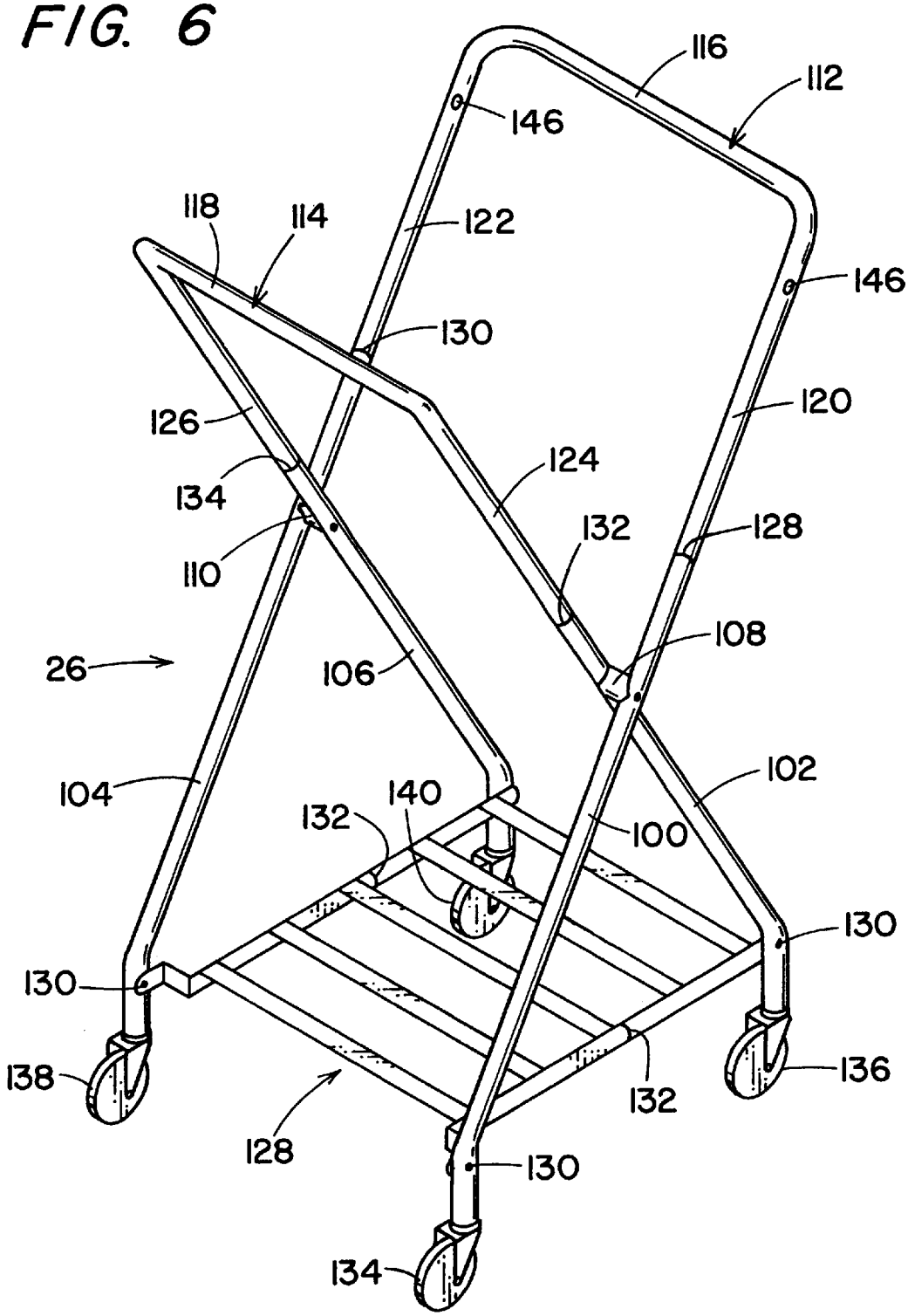
FIG. 6 is a side perspective view of the receptacle member illustrated in FIG. 5 without the receptacle bag and the detector device mounted thereon.
Figure 7:
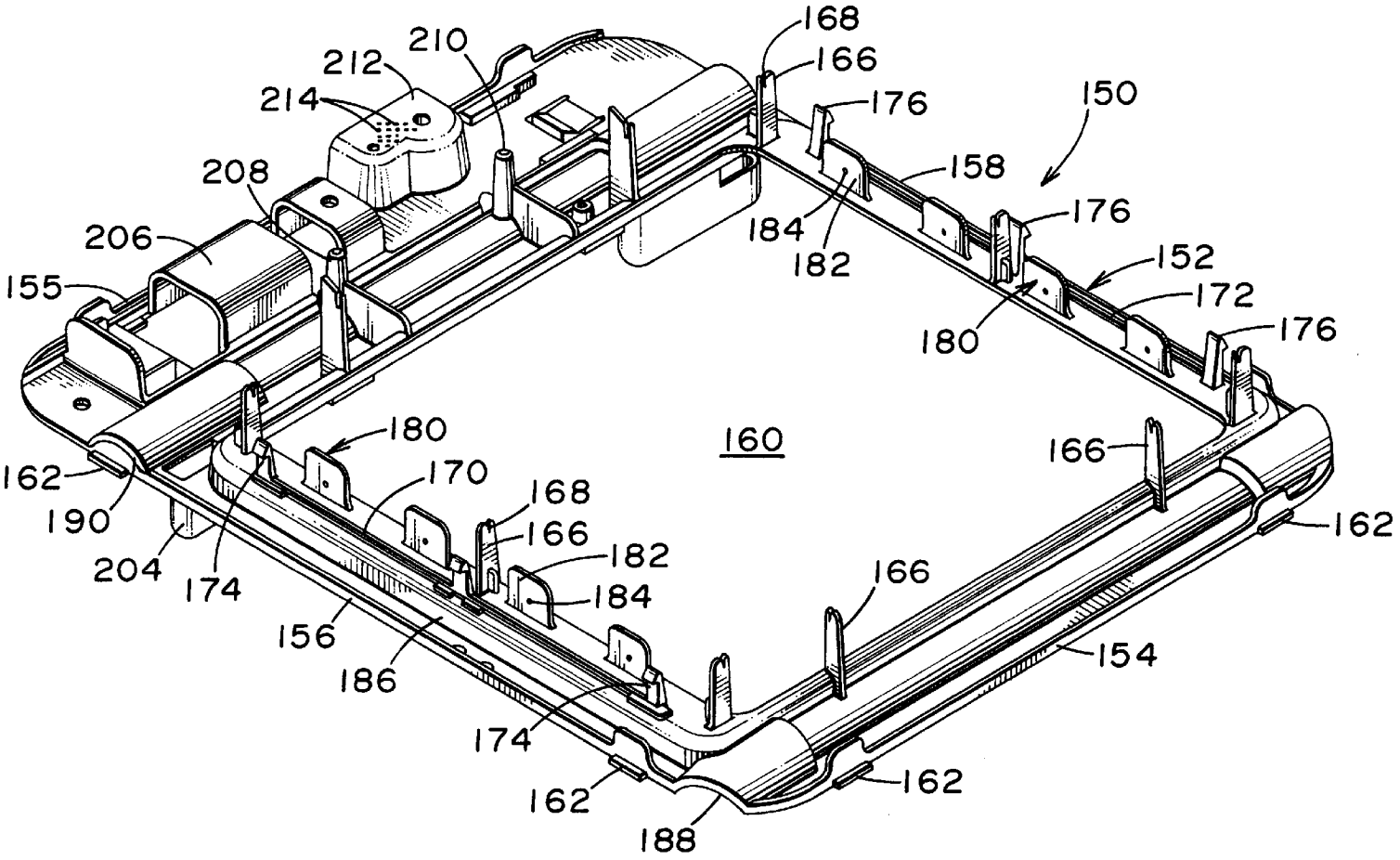
FIG. 7 is a top, frontal perspective view of the support assembly embodiment for a metal detector housing constructed in accordance with the present invention.
Figure 8:
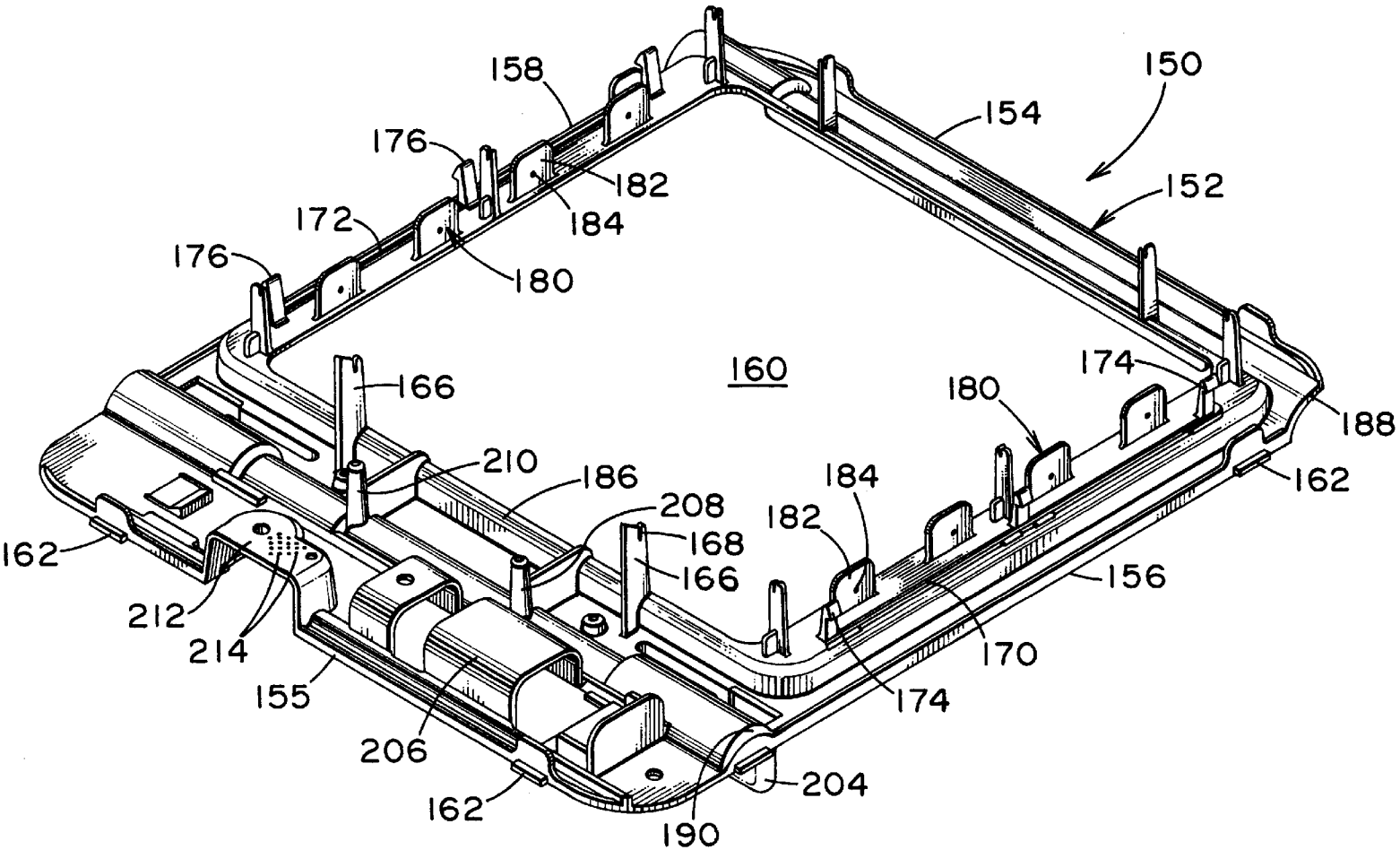
FIG. 8 is a top, rear perspective view of the support assembly embodiment of FIG. 7.
Figure 9:
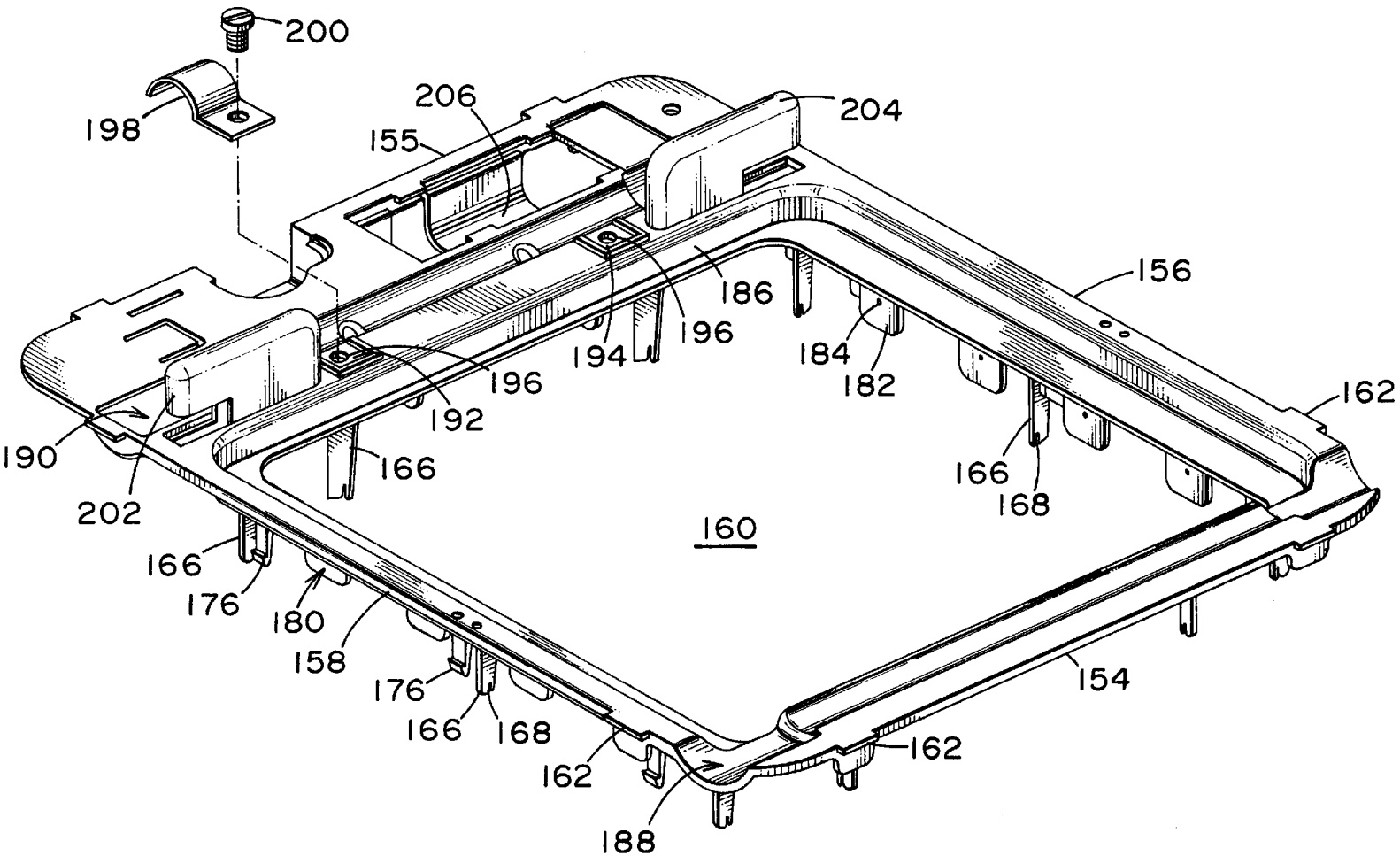
FIG. 9 is a bottom, frontal perspective view of the support assembly embodiment of FIG. 7.
Figure 10:
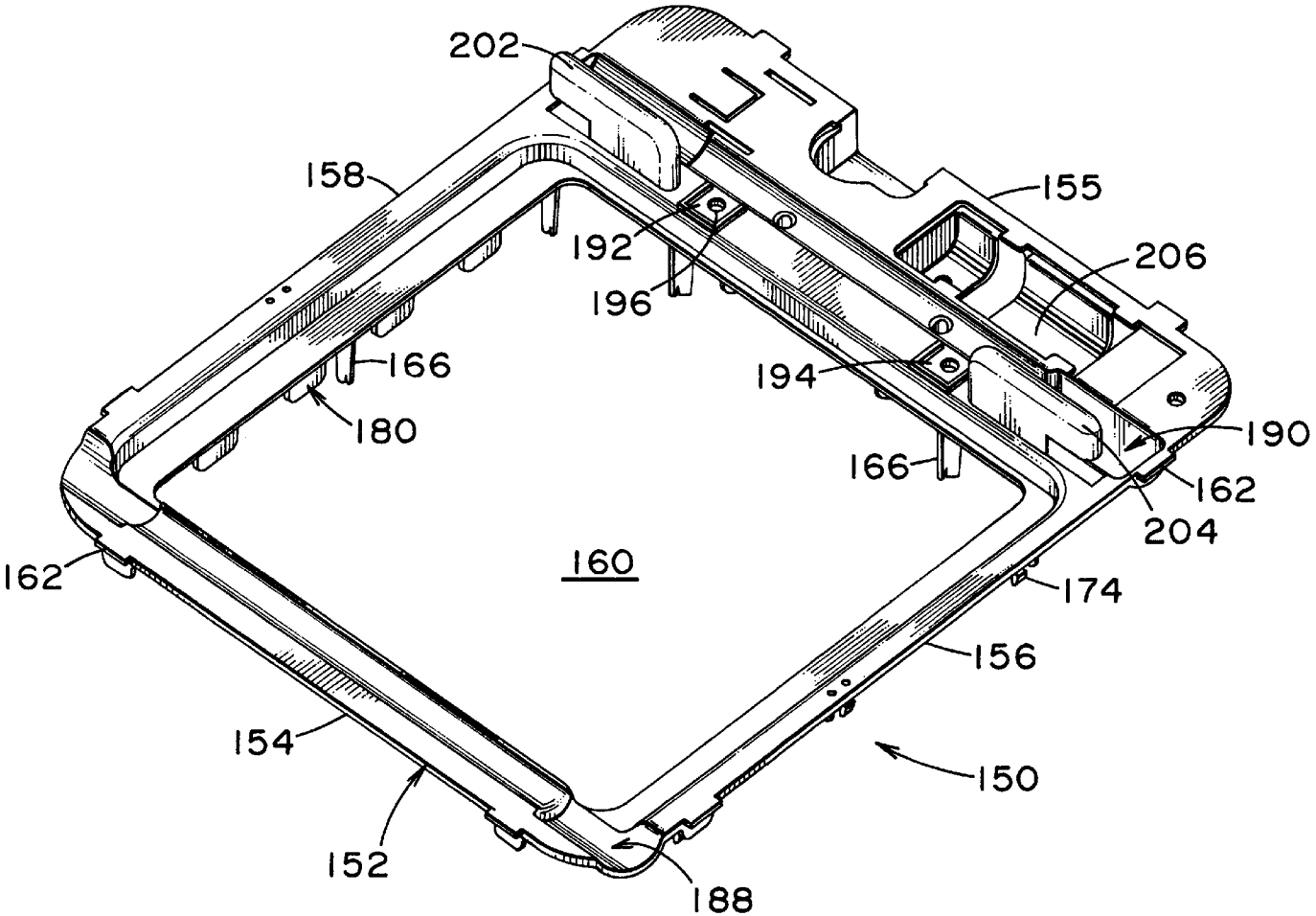
FIG. 10 is a bottom, rear perspective view of the support assembly embodiment of FIG. 9.

With particular reference to FIGS. 4–6, a typical cart or receptacle structure 26 is illustrated for holding a waste disposal bag 28 for use in conjunction with the metal detector 10. It should be understood, however, that the metal detector 10 of the present invention may be utilized with any type of receptacle and may be modified to fit the desired end use whether it be in a hospital environment, a penal institution, a kitchen environment or the like. The receptacle 26 typically includes four tubular lower leg members 100, 102, 104 and 106 that are pivotally connected together in pairs by pivotal connection members 108 and 110. The pivotal connection members 108, 110 may include rivets, pins, bolts, screws or any other appropriate member pivotally interconnecting legs 100 to 102 and 104 to 106.

The upper portions of the receptacle 26 include a pair of substantially U-shaped members 112, 114 secured to the upper portion of legs 100, 104 and 102, 106, respectively. Preferably, each U-shaped portion 112, 114 includes, respectively, a substantially transverse crossbar member 116, 118 extending between respective side frame bars 120, 122 and 124, 126. Interengaging telescoping connections 128, 130, 132 and 134 removably connect the side frame bars 120, 122, 124 and 126 to their respective lower leg members 100, 104, 102 and 106, respectively. This detachable construction, in conjunction with pivotal connections 108, 110, allows the receptacle 26 to be collapsed for shipping and storage, yet readily assembled without the use of tools. Preferably, the upper U-shaped portions 112, 114 are formed from a non-metallic material such as PVC plastic tubing in order to minimize interference with the metal detector's circuitry. The lower components of the receptacle 26 may be formed from a lightweight tubular metal material such as aluminum tubing. A bag support rack 128 includes four comer portions pivotally connected at 130 to lower end portions of the leg members 100, 102, 104 and 106. In addition, the rack 128 has a two-piece construction, with side rail members bifurcated at abutting joints 132. Accordingly, the two rack halves may be folded upwardly for storage and transportation of the receptacle 26. The leg members 100, 102, 104 and 106 terminate in respective casters 134, 136, 138 and 140 which allow the receptacle 26 to be easily rolled to a desired location for use. In use, a medical waste disposal bag 28 is placed on the rack 128 with the upper side portions 142 of the bag 28 folded outwardly over the crossbars 116, 118 to maintain the mouth of the bag 28 in an open condition for access by the aperture 30 of the device 10.

With reference to the FIGS. 4–6, the housing 12 is pivotally connected to the receptacle 26. In this particular embodiment without a support assembly, a hinge member 56 in the form of an aluminum strut has a first end pivotally secured by a fastener 58 to the side portion 18 of the housing 12. A second fastener 144 secures an opposite end of the pivot strut 56 to the aperture 146 in the upper portions of the side frame members 120. Fasteners 58 and 144 may take the form of bolts, screws, rivets or pins. It should be understood that identical pivotal struts and fastener assemblies 56 are secured on both sides of the housing 12 and attach both side portions 18, 20 of the housing 12 to the tubes 120, 122 of the receptacle 26. By virtue of this compound physical linkage, the entire housing 12 may thus be pivoted along an arc between a closed position as illustrated in FIG. 5 wherein the housing 12 is securely fixed about the transverse crossbars 116 and 118 of the receptacle 26 and the aperture 30 opens directly to the open end of the bag 28, and an open position. The open position is illustrated in the cross-referenced and incorporated U.S. Pat. No. 5,576,621 and is designed to rotate the front end member 14 away from engagement with the transverse crossbar 118 and rotate the housing 12 greater than 90° so as to gain full access to the open end of the bag 28 without passing through the aperture 30 or in any manner being hindered by the device 10. Thus, it should be noted that the housing 12 and the receptacle 26 are preferably complementary dimensions such that the crossbars 116, 118 or the receptacle 26 nest within the housing 12 at the rear 16 and front-end portions 14, respectively.

Referring now to FIGS. 1, and 7–10, the preferred embodiment is illustrated wherein a support assembly 150 is provided for releasable attachment to the housing 12. It should be understood that while the assembly 150 may be constructed from any desired material, the assembly 150 is preferably a unitary non-metallic member preferably in the form of injection molded plastic. The assembly is sized and shaped to be located beneath the housing 12 so that the housing 12 overlaps the structure 150. The assembly 150 is designed to provide structural support for the housing 12 as well as proper alignment of the various operating components of the housing 12 as explained above. Moreover, it is also designed to provide easy assembly adapted to mass production of the detector device 10.

Referring to the FIGS. 1, and 7–10 in more detail, the support assembly 150 preferably is in the form of a substantially rectangular base member 152 having a front portion 154, a rear portion 155, and two opposed side portions 156 and 158. The size and shape of the base member 152, however, is determined by the size and shape of the housing 12 in that the base member 152 is adapted to fit within and beneath the housing 12 for carrying the operating components of the device 10. In preferred form, the base member 152 includes a central aperture 160 sized and shaped so as to align with the opening 30 of the housing 12 and is releasably attachable to the housing 12. Preferably, a plurality of connection tabs 162 project outwardly from the edges of the support member 150, and a plurality of mating slots 164 are disposed in the side portions of the housing 12 for selective interengagement with the tabs 162.

A plurality of mounting posts 166 project upwardly into the housing 12 when the base member is in place beneath the housing 12. The posts 166 are preferably spaced along the front portion 154, the rear portion 155 and both side portions 156, 158 so as to encircle the aperture 160. Each post 166 preferably includes a notch portion 168 at the distal end thereof adapted to carry the induction member, which in the embodiment previously illustrated in FIG. 1 is in the form of an induction coil 82. In this manner, the induction coil 82 surrounds the opening 30 and aperture 160 so as to detect any metallic objects passing through or near the opening 30 and aperture 160 as previously discussed.

As discussed above, the preferred form for the sensing mechanism of the detection device 10 of the invention is a plurality of pulse emitting members in the form of infrared light emitting diodes 86 (FIGS. 2–3) positioned along one side portion 156 of the support assembly 150, and a plurality of pulse receiving members in the form of infrared light phototransistors 88 (FIGS. 2–3) positioned opposite the diodes 86 along the opposite side portion 158. While any type of arrangement may be used to mount the pulse emitting and receiving members 86, 88 to the support assembly 150, they are preferably mounted, respectively, to a pair of circuit boards (not illustrated) using known technology. In turn, a first slot 170 is disposed in the base member side portion 156, and a second slot 172 is disposed in the opposite base member side portion 158. The slot 170 is sized and positioned so that the circuit board carrying the pulse emitting members 86 can be readily placed therein in a predetermined position. Likewise, the slot 172 is sized and positioned so that the circuit board carrying the pulse receiving members 88 can be readily placed therein in a predetermined position immediately opposite the light emitting members 86 across the opening 30. A plurality of spring clips 174 are provided to firmly hold a circuit board within the slot 170, while a plurality of spring clips 176 are likewise provided to firmly hold a circuit board within the slot 172.

Several problems exist in previous metal detection designs. These problems include interference with the light receiving members by ambient light and cross-pulse sensing. In ambient light interference, outside (ambient) light may be detected by the light receiving members 88 in addition to the pulsed light emitted by the light emitting members 86, and such erroneous detection can cause errors. Moreover, the light pulses emitted may be of sufficient width that they are received by more than one light receiving member 88, rather than be received only by the receiving member 88 directly opposite the emitting member 86. This too can interfere with the proper operation of the device. To eliminate these problems in the present invention, a plurality of pulse regulating elements 180 are provided at each side portion 156, 158. In preferred form, each light regulating element 180 is in the form of a planar ear plate 182 projecting upwardly from the base member 152 into the path of the light emitted from the light emitting members 86 and received by the light receiving members 88. Each ear plate 182 includes a pinpoint opening 184 designed to narrow the width of the light pulse passing therethrough. In preferred form, an ear plate 182 is positioned adjacent each light emitting member 86, and an ear plate 182 is likewise positioned adjacent each light receiving member 88. In this manner, the width of the light beam emitted from each light emitting member 86 is narrowed as it passes through the pinpoint opening 184 of the adjacent ear plate 182 and is again likewise narrowed as it passes through the opening 184 of the plate 182 adjacent the light receiving member 88. In this manner, ambient light is blocked from being received by the light receiving members 88 due to the proximity of the plate 182 to the receiving members 88, since only the narrowed light passing through the adjacent plate opening 184 is received by the light receiving member 88. In addition, cross-pulse sensing is prevented since the light being emitted by the light emitting members 86 is immediately narrowed by the adjacent plate opening 184 rather than being allowed to spread in width as it is emitted and passes across the opening 30. Moreover, the emitted light is again narrowed by the plate opening 184 of the plate 182 adjacent the oppositely disposed light receiving member 88. Thus, only the light emitted by the oppositely paired light emitting member 86 can be received by the appropriate light receiving member 88.

To assist in the maintenance and proper placement of the operating elements of the housing 12 and device 10, the base member 152 includes an elevated stanchion portion 186 which surrounds the aperture 160. The stanchion portion 186 adds strength to the base member 152 and prevents torsional movement of the support assembly 150 when attached to the housing 12. Such torsional movement can inadvertently misalign the light emitting and receiving members thus causing errors in the signals registered by the device 10. By adding torsional stiffness throughout the support assembly 150, the stanchion portion 186 assists in the proper operation of the device 10 during use thereof.

As previously described, the housing 12 is preferably designed to be removably attached to a receptacle structure 26 in pivotal form so that the housing 12 may be rotated upwardly to remove the waste disposal bag 28. In preferred form, the housing 12 is secured to the receptacle using the support assembly 150. To accomplish this task, a first channel or trough 188 is formed along the front portion 154 and is sized and shaped to receive and rest upon the upper U-shaped portion 112 of the receptacle 26. Likewise, a second channel or trough 190 is formed in the rear portion 155 and is sized and shaped to receive and rest upon the upper U-shaped portion 114 of the receptacle 26. In preferred form, a pair of shelves 192, 194 each having a screw aperture 196 therein are formed adjacent the second channel 190. Attachment elements 198 are provided to be secured to the shelves 192, 194 by screw attachment members 200, respectively. The shape of the attachment elements 198 permits the U-shaped portion 114 of the receptacle 26 to be pivotally secured within the second channel 190 to enable the housing 12 to be pivoted away from the receptacle structure 26 while being securely maintained in place thereon.

A pair of attachment arms 202, 204 depend downwardly from each side of the rear portion 155. These attachment arms are provided for releasably securing the disposal bag 28 to the housing 12, while the opposite end of the bag 28 is hung over the upper U-shaped portion 112 of the receptacle 26 and maintained in place by the form fit between the channel 188 and the U-shaped portion 112. In addition, a battery case 206 is molded into the rear portion 155 of the base member 152, while a pair of posts 208, 210 and a support plate 212 are provided for securing the operating circuit board (not illustrated) which carries the electronic components and alarm for the device 10, as more clearly described in the referenced U.S. Pat. No. 5,659,247. The support plate 212 preferably includes a plurality of holes 214 therein to assist in the audible capability of the alarm carried on the operating circuit board.

As can be clearly seen from the above, the support assembly of the present invention provides support structures and alignment elements for the operational components of the metal detection device. The support assembly is designed to be injection molded so as to enable ease of manufacture. Moreover, this arrangement allows mass production of the device of the invention, thus reducing the overall costs of the metal detection device. The components of the metal detection device of the invention are easily attached in proper position due to the arrangement of the support assembly of the invention, and this permits the accurate placement and maintenance of the operational components of these devices. Finally, the present invention provides a metal detector which is readily attachable and removable from wheeled receptacles and which includes a support structure which accurately positions the sensing elements of the device throughout the operational lifetime of the detector.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A support assembly for a metal detection device having a housing with a large central orifice, an induction member surrounding said orifice for generating a varying output voltage when a metal object is passed nearby, and means including pulse emitting and pulse receiving members for selectively sensing an object passing through said orifice, said support assembly comprising:

a base member having front, rear and opposed side portions sized and shaped for positioning beneath said housing, said base member having a central aperture for substantial alignment with said housing orifice when positioned beneath said housing;

a mechanism for securing said base member to said housing;

a plurality of mounting posts disposed along said base member front, rear and side portions for positioning a metal detection device induction member about the central aperture;

mounting means for said pulse emitting and pulse receiving members on opposite sides of said central aperture; and a plurality of pulse regulating elements for eliminating ambient light interference and cross-pulse sensing.

2. The support assembly as claimed in claim 1, wherein said base member securing mechanism includes attachment members for releasably joining said base member to said housing.

3. The support assembly as claimed in claim 2, wherein the housing of said metal detection device is sized and shaped to removably cover an open-ended receptacle having a pair of mounting bars, wherein said housing orifice is aligned with the open end of said receptacle to detect the passing of metal objects into said receptacle through said orifice, and wherein said base member front and rear portions include recessed channels for receiving said mounting bars and coupling elements for journaling one said mounting bar within one said channel to permit pivotal movement between said housing and said open-ended receptacle.

4. The support assembly as claimed in claim 1, wherein said plurality of pulse regulating elements comprise a pair of oppositely arranged arrays of control tabs disposed on opposite side portions of said base member, each said control tab comprising a pulse orientation and width-defining mechanism.

5. The support assembly as claimed in claim 4, wherein each said control tab comprises an upwardly extending ear element having a hole disposed in the center thereof and positioned so that the pulse passing between one said pulse emitting member and its oppositely disposed pulse receiving member is aligned between the holes of the respective oppositely disposed control tabs to limit receipt of a pulse receiving member only to the pulse of the oppositely disposed pulse emitting member to substantially eliminate ambient light interference and cross-pulse sensing and the consequent error signals associated therewith.

6. The support assembly as claimed in claim 1, wherein said pulse emitting members and said pulse receiving members are each secured to a circuit board, and wherein said mounting means comprises a pair of slots defined along each said base member side portion for receiving one said circuit board, and a plurality of spring clips for removably securing said circuit boards in said slots.

7. The support assembly as claimed in claim 6, wherein said pulse emitting members comprise a plurality of infrared light emitting diodes and said pulse receiving members comprise a plurality of infrared light phototransistors, and wherein said plurality of pulse regulating elements comprise a plurality of control tabs disposed along said base member side portions adjacent said infrared light emitting diodes and said infrared light phototransistors, each said control tab comprising a pulse orientation and width-defining mechanism adapted to align the infrared light pulse passing between said oppositely disposed control tabs adjacent one said pulse emitting diode and its oppositely disposed phototransistor to limit receipt of an infrared light phototransistor only to the pulse of the oppositely disposed pulse emitting diode to substantially eliminate ambient light interference and cross-pulse sensing.

8. The support assembly as claimed in claim 1, wherein said base member includes a stanchion support surrounding said central aperture to add torsional stiffness to said base member.

9. The support assembly as claimed in claim 1, wherein said housing includes means for controlling the operation thereof including a control circuit board, and wherein said base member rear portion includes a plurality of mounting posts to secure said control circuit board thereto beneath the housing.

10. In a metal detection device having a housing defining a central opening, a detection coil mounted proximate said housing and surrounding said opening for generating an output voltage in response to the presence of a metal object near said detection coil, means for calibrating said detection coil by comparing said output voltage to a reference voltage to establish a threshold voltage which is unaffected by transient fluctuations in the output voltage, means disposed in said housing and spaced about said opening for selectively sensing an object passing through said opening, said sensing means generating a detection signal in response to passage of an object through said opening only upon activation of said sensing means, means for activating said sensing means upon generation of an inductive member output voltage above said threshold voltage, and means for triggering an alarm in response to the generation of said detection signal, the improvement comprising:

a molded carrier member having front, rear and opposed side portions sized and shaped for positioning beneath said housing, said carrier member having a central aperture for substantial alignment with said housing opening when positioned beneath said housing;

a mechanism for releasably securing said carrier member to said housing;

a plurality of mounting posts disposed along said carrier member front, rear and side portions for positioning said detection coil about the carrier member central aperture;

mounting members for said sensing means on opposite sides of said carrier member central aperture; and a plurality of sensing means regulating elements for eliminating ambient light interference and cross-pulse sensing when generating said detection signal.

11. The improvement as claimed in claim 10, wherein said molded carrier member comprises a unitary molded member.

12. The improvement as claimed in claim 10, wherein said metal detection device further comprises said housing being sized and shaped to removably cover an open-ended receptacle having a pair of mounting bars, said housing opening being alignable with the open end of said receptacle to detect the passing of metal objects into said receptacle through said opening, and wherein said improvement further comprises said carrier member front and rear portions having recessed channels for receiving said receptacle mounting bars and coupling elements for journaling one said mounting bar within one said channel to permit pivotal movement between said housing and said open-ended receptacle.

13. The improvement as claimed in claim 10, wherein said plurality of sensing means regulating elements comprise a pair of oppositely arranged arrays of control tabs disposed on opposite side portions of said carrier member, each said control tab comprising a pulse orientation and width-defining mechanism.

14. The improvement as claimed in claim 13, wherein said sensing means comprises a plurality of pulse emitting members arranged along one side portion of said molded carrier member and a plurality of pulse receiving members arranged opposite said pulse emitting members along the opposite side portion of said molded carrier member, each said control tab comprising an upwardly extending ear element having a hole disposed in the center thereof and positioned so that the pulse passing between one said pulse emitting member and its oppositely disposed pulse receiving member is aligned between the holes of the respective oppositely disposed control tabs to limit receipt of a pulse receiving member only to the pulse of the oppositely disposed pulse emitting member to substantially eliminate ambient light interference and cross-pulse sensing and the consequent error signals associated therewith.

15. The improvement as claimed in claim 14, wherein said pulse emitting members and said pulse receiving members are each secured to a circuit board, wherein said sensing means mounting members comprise a pair of slots defined along each said carrier member side portion for receiving one said circuit board and a plurality of spring clips for removably securing said circuit boards in said slots, and wherein said pulse emitting members comprise a plurality of infrared light emitting diodes and said pulse receiving members comprise a plurality of infrared light phototransistors, said control tabs being disposed on said carrier member side portions adjacent said infrared light emitting diodes and said infrared light phototransistors with each said control tab comprising a pulse orientation and width-defining mechanism adapted to align the infrared light pulse passing between said oppositely disposed control tabs adjacent one said pulse emitting diode and its oppositely disposed phototransistor to limit receipt of an infrared light phototransistor only to the pulse of the oppositely disposed pulse emitting diode to substantially eliminate ambient light interference and cross-pulse sensing.

16. The improvement as claimed in claim 10, wherein said carrier member includes a stanchion support surrounding said central aperture to add torsional stiffness to said carrier member.

17. A device for detecting metal objects as they are inserted into a receptacle having an open upper end, said device comprising:

a housing sized and shaped to cover said receptacle open upper end, said housing defining a central opening for access to said open upper end;

a molded base member for carrying said housing and having front, rear and opposed side portions sized and shaped for positioning beneath said housing, said base member having a central aperture for substantial alignment with said housing opening when positioned beneath said housing;

a mechanism for releasably securing said base member to said housing;

an inductive element disposed within said housing surrounding said opening for generating an output voltage when a metal object passes proximate thereto;

a plurality of mounting posts disposed along said base member front, rear and side portions for positioning said inductive element about the base member central aperture;

means for automatically calibrating said induction element by comparing said output voltage to a reference voltage to provide a threshold voltage which is unaffected by transient environmentally induced fluctuations in said output voltage;

means disposed in said housing and spaced about said base member central aperture for selectively sensing the presence of an object passing through said opening and aperture, said sensing means generating an electric signal in response thereto upon activation of said sensing means, said sensing means including mounting members therefor arranged on opposite side portions of said base member central aperture;

a plurality of sensing means regulating elements disposed for eliminating ambient light interference and cross-pulse sensing when generating said detection signal;

means for activating said sensing means upon generation of an inductive means output voltage above said threshold voltage; and means for triggering an alarm detection signal in response to generation of said sensing means electric signal.

18. The device as claimed in claim 17, wherein said open-ended receptacle includes a pair of mounting bars, said housing opening being alignable with the open end of said receptacle to detect the passing of metal objects into said receptacle through said opening, and wherein said base member front and rear portions include recessed channels for receiving said receptacle mounting bars, and coupling elements for journaling one said mounting bar within one said channel to permit pivotal movement between said housing and said open-ended receptacle.

19. The device as claimed in claim 17, wherein said sensing means comprises a plurality of pulse emitting members arranged along one side portion of said molded base member and a plurality of pulse receiving members arranged opposite said pulse emitting members along the opposite side portion of said molded base member, and wherein said plurality of sensing means regulating elements comprise a pair of oppositely arranged arrays of control tabs disposed on opposite side portions of said base member and aligned with said pulse emitting and pulse receiving members, each said control tab comprising a pulse orientation and width-defining mechanism.

20. The device as claimed in claim 19, wherein each said control tab comprises an upwardly extending ear element having an aperture disposed in the center thereof and is positioned so that the pulse passing between one said pulse emitting member and its oppositely disposed pulse receiving member is aligned between the apertures of the respective oppositely disposed control tabs to limit receipt of a pulse receiving member only to the pulse of the oppositely disposed pulse emitting member to substantially eliminate ambient light interference and cross-pulse sensing and the consequent error signals associated therewith.

21. The device as claimed in claim 20, wherein said pulse emitting members and said pulse receiving members are each secured to a circuit board, wherein said sensing means mounting members comprise a pair of slots defined along each said base member side portion for receiving one said circuit board and a plurality of spring clips for removably securing said circuit boards in said slots, and wherein said pulse emitting members comprise a plurality of infrared light emitting diodes and said pulse receiving members comprise a plurality of infrared light phototransistors, said control tabs being disposed on said base member side portions adjacent said infrared light emitting diodes and said infrared light phototransistors with each said control tab comprising a pulse orientation and width-defining mechanism adapted to align the infrared light pulse passing between said oppositely disposed control tabs adjacent one said pulse emitting diode and its oppositely disposed phototransistor to limit receipt of an infrared light phototransistor only to the pulse of the oppositely disposed pulse emitting diode to substantially eliminate ambient light interference and cross-pulse sensing.

22. The device as claimed in claim 17 wherein said base member includes a stanchion support surrounding said central aperture to add torsional stiffness to said base member to maintain the pulse alignment between each said pulse emitting diode and its oppositely disposed phototransistor.

* * * * *